US011280110B1

(12) United States Patent
Moeller

(10) Patent No.: US 11,280,110 B1
(45) Date of Patent: Mar. 22, 2022

(54) ENTRY DOOR FRAME REINFORCEMENT ASSEMBLY

(71) Applicant: David W Moeller, Flowery Branch, GA (US)

(72) Inventor: David W Moeller, Flowery Branch, GA (US)

( * ) Notice: Subject to any disclaimer, the term of this patent is extended or adjusted under 35 U.S.C. 154(b) by 538 days.

(21) Appl. No.: 16/350,633

(22) Filed: Dec. 12, 2018

Related U.S. Application Data

(60) Provisional application No. 62/762,434, filed on May 5, 2018.

(51) Int. Cl.

| | |
|---|---|
| ***E05B 15/02*** | (2006.01) |
| ***E06B 5/11*** | (2006.01) |
| ***E05B 17/20*** | (2006.01) |
| ***E05B 63/08*** | (2006.01) |
| ***E06B 1/52*** | (2006.01) |

(52) U.S. Cl.
CPC ..... *E05B 15/0205* (2013.01); *E05B 17/2084* (2013.01); *E05B 63/08* (2013.01); *E06B 1/52* (2013.01); *E06B 5/113* (2013.01)

(58) Field of Classification Search
CPC ..... Y10T 292/68; E05B 15/0205; E05B 17/2084; E05B 17/2003; E05B 63/08; E06B 1/52; E06B 5/113
USPC ..... 292/340, 341.14, 356; 52/204.1, 240.1; 49/460, 503
See application file for complete search history.

(56) References Cited

U.S. PATENT DOCUMENTS

| | | | | |
|---|---|---|---|---|
| 3,271,063 A | | 9/1966 | Garrett | |
| 3,918,207 A | | 11/1975 | Aliotta | |
| 4,057,275 A | * | 11/1977 | La Beaud | E05B 15/0205 292/340 |
| 4,171,836 A | * | 10/1979 | St. Aubin | E05B 15/0245 292/341.18 |
| 4,171,837 A | | 10/1979 | McRoy | |
| 4,174,862 A | * | 11/1979 | Shane | E05B 17/2084 292/340 |

(Continued)

FOREIGN PATENT DOCUMENTS

| | | |
|---|---|---|
| CN | 107386878 | 5/2018 |
| DE | 199 38 547 A1 | 1/2001 |

(Continued)

OTHER PUBLICATIONS

Global Security Experts Inc., "Door Jamb Reinforcement Systems vs. Security Door . . . " viewed Jun. 7, 2018, dates unknown.

(Continued)

*Primary Examiner* — Kristina R Fulton
*Assistant Examiner* — Steven A Tullia
(74) *Attorney, Agent, or Firm* — James K. Poole, Esq.

(57) ABSTRACT

A door frame profile and reinforcement assembly to increase the resistance of an entry door and door frame to forced entry by an intruder. Increased resistance is achieved by fitting and securing a U-shaped bar within a machined slot in the back of the door frame and attaching a shaped plate or plates that fits within the shaped bar and retains the door's throw bolt of the deadbolt and/or latch of the door lock. Optionally, with stronger door frames, the shaped plate alone may suffice, and the plate can be modified to a simple L-shaped form, a portion of which is inserted into a narrow groove which replaces the machined slot.

11 Claims, 9 Drawing Sheets

(56) References Cited

U.S. PATENT DOCUMENTS 4,195,870 A * 4/1980 Percoco ..... E05B 15/0205 292/340
4,281,480 A * 8/1981 Wendt ..... E06B 1/34 49/504
4,295,299 A * 10/1981 Nelson ..... E06B 1/34 292/246
4,345,787 A * 8/1982 Dabrowski ..... E05B 17/2003 292/346
4,416,087 A 11/1983 Ghaiak
4,717,185 A * 1/1988 Hartley ..... E05B 15/0205 292/340
4,770,452 A * 9/1988 Petree, Jr. ..... E05B 15/0205 292/340
4,854,621 A * 8/1989 Baldwin ..... E05B 15/0205 292/340
4,858,384 A 8/1989 Blankenship
4,862,658 A * 9/1989 Barker ..... E06B 1/52 52/217
4,865,370 A * 9/1989 Francis ..... E05B 15/0205 292/340
4,993,764 A * 2/1991 Barker ..... E06B 1/32 292/340
5,070,650 A 12/1991 Anderson
5,076,626 A 12/1991 Tiddy et al.
5,127,690 A * 7/1992 Kim ..... E05B 15/0245 292/340
5,154,461 A * 10/1992 Prescott ..... E05B 17/2084 292/272
5,241,790 A 9/1993 Schimpf
D354,670 S * 1/1995 Simon ..... E05B 15/0205 D8/314
5,474,347 A 12/1995 Vigneault et al.
5,556,509 A 10/1996 Long
5,570,917 A * 11/1996 Cutrer ..... E05B 15/0205 16/392
5,581,948 A * 12/1996 Simonsen ..... E05B 15/0205 16/388
5,836,628 A 11/1998 Beier
5,934,024 A 8/1999 Simpson
6,082,049 A * 7/2000 Hudson ..... E05B 15/0205 292/346
6,178,700 B1 1/2001 Mayer, Jr.
6,418,669 B1 7/2002 Suter
6,691,466 B2 2/2004 Childress
6,834,897 B1 * 12/2004 Walker ..... E05B 15/0205 292/340
6,857,672 B1 2/2005 Drew, II
7,134,246 B1 11/2006 Olberding et al.
7,165,793 B2 * 1/2007 Richmond ..... E05B 15/0205 292/340
7,467,818 B2 12/2008 Young
7,946,635 B2 5/2011 Canerdy, Jr.
8,132,832 B2 3/2012 Anderson
8,510,995 B2 8/2013 Fulton et al.
8,793,936 B2 8/2014 Fulton et al.
8,887,457 B1 11/2014 Knight
8,938,915 B2 1/2015 Jones et al.
2007/0029823 A1 2/2007 Gatrell
2008/0202034 A1 * 8/2008 Campbell ..... E06B 1/6023 49/504
2009/0077909 A1 * 3/2009 Barthel ..... E06B 1/52 52/204.1
2010/0115862 A1 5/2010 Young
2010/0122502 A1 * 5/2010 Young ..... E06B 5/113 52/204.1
2010/0201138 A1 * 8/2010 Sauder ..... E06B 1/603 292/340
2012/0181801 A1 * 7/2012 Willis ..... E05B 15/0205 292/338
2012/0228887 A1 9/2012 McMullen
2013/0074414 A1 * 3/2013 Jones ..... E05B 17/2084 49/462
2014/0346787 A1 * 11/2014 Martin, Jr. ..... E05B 15/0205 292/289
2015/0013249 A1 * 1/2015 Nielsen ..... E05B 15/0205 52/213
2015/0252589 A1 9/2015 Johnson
2017/0159326 A1 5/2017 Piston

FOREIGN PATENT DOCUMENTS

DE 202008005087 U1 * 7/2008 ..... E05B 15/0205
GB 2523171 A * 8/2015 ..... E05D 11/0027

OTHER PUBLICATIONS

PRweb, Jordan Frankel, "Global Security Experts Inc. Invention contest . . . " viewed Jun. 8, 2018, date unknown.
Front door Security Devices & Hardware, "Best Door Reinforcement Kit 208," viewed Jun. 8, 2018, date(s) unknown.
ASTM Intl., ASTM F476-14, "Standard Test Methods for Security of Swinging Door Asemblies," 2014, West Conshohocken, PA.

* cited by examiner

ENTRY DOOR FRAME REINFORCEMENT ASSEMBLY

CROSS-REFERENCE TO RELATED APPLICATIONS

This application claims the benefit of my provisional application DWMEV-6P, U.S. Ser. No. 62/762,434, for "ENTRY DOOR FRAME REINFORCEMENT ASSEMBLY," filed May 5, 2018.

BACKGROUND OF THE INVENTION

1. Field of the Invention

The present invention relates to the field of door frames and, in particular, to a modified entry door frame profile and mating entry door strike frame reinforcement assembly that improves the ability of the strike frame and the door to resist forced entry.

2. Description of Relevant Art

Forced entry into residences and commercial buildings is, unfortunately, an all too common occurrence. Home invasions have occurred that have resulted in not only loss of property but also serious injuries and even death to the occupants. The ability of a typical residential front entry door and door frame to resist a forced entry is limited due to the small volume of wood or plastic composite (typically 0.75"×0.5"×1") that the throw bolt of the deadbolt has to retain it in the door frame. The thin stamped metal pieces mounted on the face of the frame that surround the deadbolt and latch in a typical entry door hardware system are more decorative than protective. As such, the need for improved resistance to forced entry is well known, and prior art exists that attempts to address this need.

Patents such as Blankenship, U.S. Pat. No. 4,858,384, Long, U.S. Pat. No. 5,566,509, Canerdy, Jr., U.S. Pat. No. 7,946,635 B2, Anderson, U.S. Pat. No. 8,132,832 B2, Jones, et. al. U.S. Pat. No. 8,938,915 B2 and others present door strike frame reinforcements in the form of a shaped metal strip with cutouts or punch outs for the throw bolt and latch. The shaped strip mounts onto the rabbeted face portion of an existing door strike frame, between the edge of the door containing the lock set and the face of the thinner part of the door frame, to reinforce it. The shaped strip is mounted with a number of long wood screws that secure the strip to the face of the door frame and potentially into the framing in the surrounding wall. The reinforcement does not require additional machining of the door frame but as a result the gap between the edge of the door and the door frame is reduced and could potentially interfere with the normal closure of the door. The strip would also be visible and would detract from the appearance of the door frame.

Patents such as Knight, U.S. Pat. No. 8,887,457 B1 and others describe systems that have significant sections of the door frame machined away and replaced by a shaped metal bar with openings for the latch and throw bolt. The bar is then secured through the remaining thickness of the door frame and into the framing in the surrounding wall. The machining required to prepare the door frame for installation of the bar is extensive and would be very difficult to perform without specialized templates or other purpose-built fixtures. As such, fitting this system to an existing door frame would be very difficult to accomplish at the location of a home using the typical hand tools available during home construction or carried by a contractor trying to fit the system to an existing home.

Patents and applications such as Young, U.S. Pat. No. 7,467,818 B2, Johnson, US 2015/0252589 A1 and others describe systems that include shaped sheet metal pieces which are attached to be back of the door frame and wrap around the rabbeted edge of the door frame and over part of the face of the door frame in the area where the deadbolt is located. The sheet metal pieces are then secured with screws into the frame and/or the adjacent wall structure. The reinforcement requires little or no machining of the door frame, but as a result the gap between the edge of the door and the frame is reduced and could potentially interfere with the normal closure of the door. The sheet metal pieces would also be visible and would detract from the appearance of the door frame.

Patents such as Simpson, U.S. Pat. No. 5,934,024, Hudson, U.S. Pat. No. 6,082,049, Childress, U.S. Pat. No. 6,691,466 B1 and others describe systems that are mounted on the back face of the frame or are inserted into the edge or face of the rabbeted area of the frame in the area where the deadbolt is mounted. These systems all require some specialized machining of the door frame to be accomplished to allow them to be secured in a way that the system will mostly be hidden from view.

Patents such as Mayer, Jr., U.S. Pat. No. 6,178,700 B1, Olberding et. al., U.S. Pat. No. 7,134,246 B1 and others describe systems that are mounted between the back of the door frame and the surrounding wall structure. These systems are quite large in size, complex and would require the installer to accurately place and secure each component with numerous fasteners to mount them correctly.

In view of the foregoing disadvantages and limitations found in the prior art for the reinforcement of entry door frames, there is need for an improved method or system.

SUMMARY

The embodiments disclosed and claimed herein comprise components of reinforcement assemblies having various shapes and sizes which are designed and adapted for installation on the back of one leg, specifically the strike side leg, of a door frame assembly, whether during factory manufacture or field installation. They are all designed to improve the impact resistance of a door installed in the reinforced frames of various types, when impact force is applied to a door which is closed and locked with a latch and deadbolt to the reinforced strike side frame leg. Such impacts are typically applied to an area of the door adjacent to the frame leg during an attempted forced entry or similar event. Therefore, although the most basic embodiments comprise shaped plates as described below, preferably in combination with a U-shaped bar as also described, the claimed embodiments range from assemblies comprising one or two of such shaped plates up to complete reinforced door frames and pre-hung doors including such frames. Thus, much of the disclosure below (including examples) will necessarily concern the effects of the reinforced frames on the impact resistance of the door, lock and deadbolt when installed in such reinforced frames.

The purpose of the door frame profile and reinforcement assembly disclosed below is to improve the ability of the door and door frame entry system to resist the impact of an intruder attempting to force entry. Improved resistance to forced entry is achieved by providing a shaped plate attached to the back of the door frame that the throw bolt of the door deadbolt contacts or, preferably, two shaped plates so both the throw bolt and latch of the door lockset come in contact with the plates when the door is closed and the deadbolt and lock are in their locked position. The shaped plate or plates are then preferably secured to a shaped bar that is located in and secured within a shaped slot (rabbet) in the back of the door frame or simply secured directly within a shaped slot (rabbet) in the back of the door frame without the benefit of the shaped bar.

The improved entry door frame reinforcement assembly preferably comprises two main components. The first component is a U-shaped bar that seats into and is secured within a shaped slot in the back of the door frame that is oriented parallel to the length of the door frame. The second component is a shaped plate that attaches to the shaped bar and the back of the door frame and is oriented parallel to the back of the door frame in the location of the door lock and/or deadbolt to be reinforced. The system can utilize one or, preferably, two of the shaped plates so that the throw bolt of the deadbolt and latch of the door lock are both reinforced. The purpose of the U-shaped bar is to reinforce and better secure the shaped plate or plates if the door frame is constructed of a soft or low strength wood or composite. A set of threaded (or other mechanical) fasteners designed to securely connect the pieces to the back of the door frame directly and indirectly into the surrounding wall framing is also part of the assembly. The minimum length of a U-shaped bar that can secure two shaped plates needs to be greater than about 9" as the standard distances between the center lines of the lock and deadbolt are either 5.5" or 6". The maximum length of the U-shaped bar is expected to be about 24", as testing has shown shorter bar lengths provide sufficient reinforcement. However, the true maximum length of the U-shaped bar could be as long as the actual frame leg, which is typically 81" to 97" in length.

The components of the above system can be cast, stamped, bent, formed, molded, machined or otherwise fabricated from metals or other materials that have sufficient structural strength to endure the loads placed on them during a forced entry attempt. For instance, sheet steel, including various alloys, brass, bronze and high strength polymeric composites can be used.

The shaped slot in the back of the door frame can be easily incorporated into the door frame when it is produced by either moulding (wooden door frame) or extrusion (plastic composite door frame). As the location of the slot is on the back of the door frame and does not alter the fit, form or function of the door frame, having this become the standard profile for door frames is feasible. The adoption of this as the standard profile would actually reduce the cost of manufacture for door frame producers as it would reduce the material content of extruded door frames and provide additional sawdust revenue for wood door frame producers. The machining required to cut the shaped slot into the back of an existing door frame can be accomplished with the use of a small table saw fitted with a dado saw blade set. As such, an existing strike frame leg could be modified to receive the security strike at a typical job site.

Door frames come in a range of widths (typically 4.5" to 12"), as they must match the overall thickness of the exterior wall construction used. The change in door frame width is accomplished by altering only the width of the thicker portion of the door frame as the thinner rabbeted portion is kept the same width to match the door thickness. As the location of the shaped slot is a set distance from the thin rabbeted edge of the door frame, changes in the overall width of the door frame have no impact on the fit of the security strike system, so one size of shaped plate and bar will work for a range of door frame widths.

The U-shaped bar is shaped to fit into and be secured within the shaped slot in the back of the door frame. The shaped bar has a cross-sectional shape and thickness resembling a broad U-shape or channel iron. When combined with the strength of the material chosen, the resulting combination will resist deformation or fracture due to being subjected to impact loading. The length of the shaped bar is sufficient, with enough fastening points, to spread the impact loads along enough length of the door frame to prevent the wooden or composite frame from failing and giving way, or to minimize the risk of such failure.

The shaped plate is shaped to fit within and be secured to the shaped bar and secured by fasteners into the door frame. The shaped plate is of a material and thickness sufficient to resist deformation or fracture due to impact loads. The shaped plate has an opening for the latch or throw bolt to pass through and the opening has a perpendicular rectangular flange that extends into the opening drilled into the door frame for the latch and/or throw bolt. This flange provides for more of the length of the latch or throw bolt to make contact with and be supported by the shaped plate. The shaped plate is also fitted with two slots that are located, oriented and sized so that wood screws of sufficient length can be driven through the rabbeted face of the door frame, pass through these slots and then into the wall framing that surrounds the door entry. The locations of the slots align with the area of the rabbet next to the slot cut to hold the weatherstrip so that the heads of the fasteners will be covered by the weatherstrip after it is installed, and thus the presence of these fasteners is hidden from view. As with the shaped bar, the length of the shaped plate(s) should be sufficient to spread impact loads along enough length of the door frame to minimize the risk of failure under impact.

Not all applications may require that the combination of the U-shaped bar and shaped plate be used to achieve the required resistance to forced entry (e.g., when the door frame is composed of quality hardwood as opposed to low grade softwood). For these applications, the shaped bar could be eliminated and the shaped plate secured directly into the shaped slot in the door frame. Another alternative is that the width of the shaped slot can be reduced and the portion of the shaped plate that fits within the shaped slot can be reduced to a simple flange and the locations of the fasteners for the shaped plate relocated.

At its simplest, an embodiment shown in FIG. 7 comprises a flat plate with a hole cut to coincide with the hole(s) in the door frame for the door latch and/or deadbolt, with a portion of the plate extending along the edge opposite this large hole bent approximately perpendicular to the plate's surface and adapted to be inserted into a narrow groove cut in the door frame to fit this portion. This simple version is suitable for use with door frames which are strong and durable due to the use of hardwood, thicker material, reinforcements or polymer composites. Longitudinal slots parallel to the plate's sides are provided to enable the plate to be positioned to coincide with the latch and/or deadbolt holes before installation with mechanical fasteners. Additional attachment holes are provided for securely attaching the plate to the door frame with mechanical fasteners.

The embodiment shown in FIG. 6 is a variation which is also designed for use with the strong door frames, but the shaped plate includes a double 90 degree bend on the edge opposite the latch hole which provides an offset portion perpendicular to the plate's surface and properly sized to permit a flat portion parallel to the plate's surface to fit within a wider rectangular groove cut to size in the door frame and to fit flush against the bottom of this groove, where it can be secured in place using a number of attachment holes and mechanical fasteners.

The embodiments shown can be added to reinforce an existing door and frame assembly by removing the existing door and entry frame, cutting the slot required in the back of the strike side frame leg, installing the shaped bar and plate(s) and reinstalling the now reinforced door and frame assembly. For existing doors that have been subject to forced entry damage, the embodiment and a replacement frame leg can be utilized to both repair and reinforce the existing door and frame assembly. The damaged door and frame assembly would be removed, the damaged/broken strike side frame leg removed, a new replacement leg with the machined slot and the embodiment mounted would be attached to complete the door and frame assembly and then the repaired and reinforced door and frame assembly reinstalled. Finally, a strike side frame leg with the machined slot and the embodiment attached can be utilized with a door and other frame components to produce a reinforced pre-hung door unit for use in new construction or when forced entry damage or other reasons prevent the existing door and frame assembly from being reused. Such a pre-hung door assembly would comprise a door frame comprising two legs, header and sill, with reinforcement assemblies for the latch and/or throw bolt installed in the latch-side leg and the door hung by hinges on the opposite leg.

As a result, some known deficiencies of the current entry door frame reinforcing assemblies are addressed and overcome.

BRIEF DESCRIPTION OF THE DRAWINGS

The invention will be better understood and aspects other than those set forth above will become apparent when consideration is given to the following detailed description, the appended claims and drawings. The same numerals are used to designate like components in these figures. Such description makes reference to the annexed drawing wherein:

DETAILED DESCRIPTION OF PREFERRED EMBODIMENTS

In general, the following description adopts a terrestrial frame of reference, in which the bottom of a component is considered to be the side nearest the floor or earth when in normal use, and the top being the side opposite and facing upward. The term "face" is used to identify the portion of the door frame that is in closest proximity to the door and is visible after installation. The term "back" is used to identify the reverse portion of the door frame that is in closest proximity to the surrounding wall and its internal framing and is not visible after installation. The term "and/or" is used in the conventional sense, in which "A and/or B" indicates that A or B, or both, may be present.

A variety of typical mechanical fasteners can be used to assemble the components of the system embodiments described below, including without limitation nails, staples of various types, machine screws and bolts, wood and sheet metal screws, dowels and pins of various sorts. Persons skilled in the art will be well prepared to use the mechanical fasteners provided with the assembly or to provide or substitute fasteners of their own choices.

Figure 1:
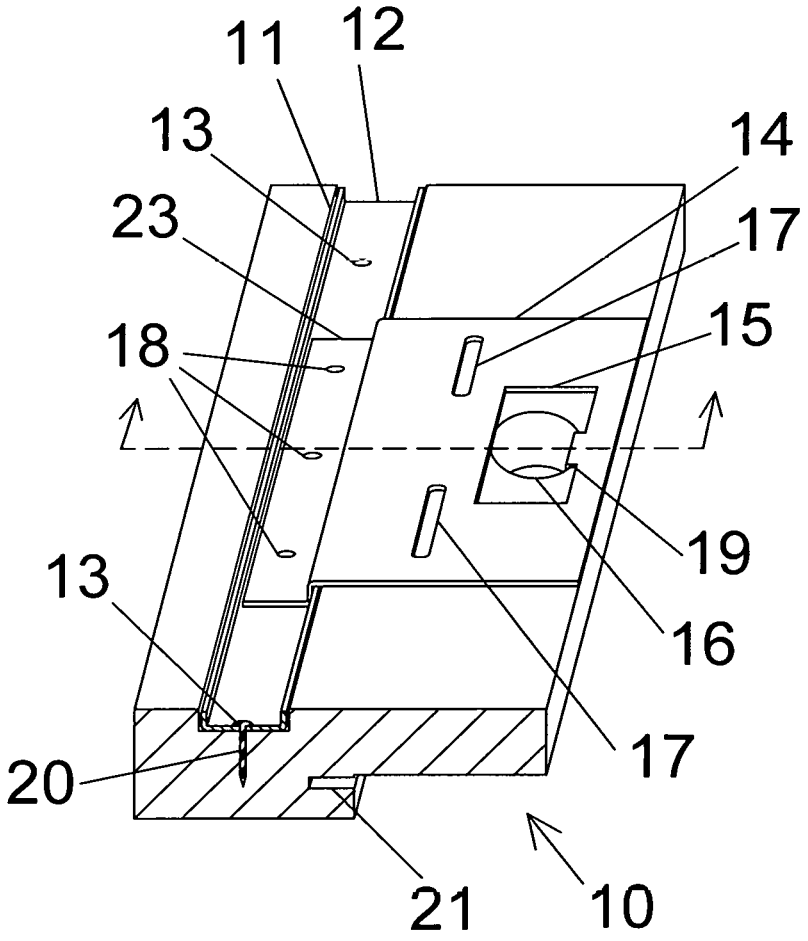
FIG. 1 is an oblique sectional view of the back of a door frame fitted with the described assembly.

With reference to FIG. 1, the back of the door frame (10) is shown with the shaped slot (11) machined or extruded into it. Positioned where the lock/latch bore (16) is located on the door frame (10) and within the shaped slot (11) is a U-shaped bar (12). The U-shaped bar (12) is fitted with a series of attachment holes (13) that allow fasteners (20) to pass through the shaped bar (12) and secure it in position within the shaped slot (11) and the door frame (10). The width and depth of the shaped slot (11) are slightly greater than the width and depth of the U-shaped bar (12) so as to allow the U-shaped bar (12) to be fully contained within it. Shaped plate (14) is then aligned with the lock/latch bore (16) and set into place so that it lies flat on the back of the door frame (10) and the offset section (23) of the shaped plate (14) sets within the U-shaped bar (12) and shaped slot (11). The shaped plate (14) is then attached to the back of the door frame (10) by inserting and securing fasteners (not shown) through the attachment holes (18) in the offset section (23) of the shaped plate (14) which align with slotted holes (hidden in this view) in the U-shaped bar (12). Shaped plate (14) has a lock/latch opening (15) that surrounds the lock/latch bore (16) that is cut into the frame (10) to allow for the throw bolt of the deadbolt or latch of the lockset (not shown) to pass through the frame (10). The edge of the lock/latch opening (15) in shaped plate (14) has a support flange (19) which extends into the lock/latch bore (16). The length of the support flange (19) is such that it does not extend fully through the lock/latch bore (16) so as not to interfere with the mounting of the decorative lock or latch cover (not shown). The support flange (19) is of a width and location so that it fits within the lock/latch bore (16) but still allows sufficient clearance for the latch or throw bolt (not shown) to be extended into and through the lock/latch bore (16). The support flange (19) helps to secure shaped plate (14) to door frame (10) and to support a longer length of the latch or throw bolt within bore (16). The shaped plate (14) also features two slotted holes (17) which are positioned so that, during installation, long fasteners (not shown) can be driven or screwed through the face of the door frame (10) adjacent to the weatherstrip slot (21), pass through the shaped plate (14) and penetrate and be secured to the framing within the wall that surrounds the entry. The location of the slotted holes (17) is such that the heads of the fasteners will be hidden from view when the weatherstrip (not shown) is installed into the weatherstrip slot (21) machined into the face of the door frame (10).

Figure 2:
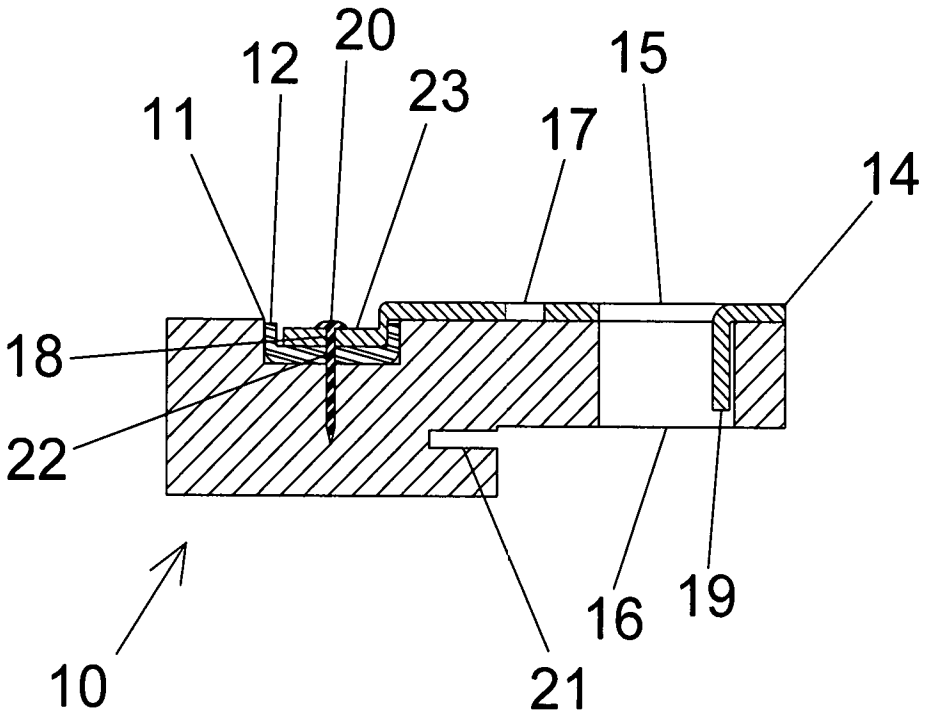
FIG. 2 is a cross section AA' view of the door frame depicted in FIG. 1 with the described assembly attached.

With reference to FIG. 2, the door frame (10) cross section is shown with the shaped slot (11) machined or extruded into it. Positioned where the lock/latch bore (16) is located on the door frame (10) and within the shaped slot (11) is the U-shaped bar (12). The width and depth of the shaped slot (11) are slightly greater than the outer width and depth of the U-shaped bar (12) so as to allow the U-shaped bar (12) to be fully contained within it. The shaped plate (14) is then aligned with the lock/latch bore (16) and set into place so that it lies flat on the back of the door frame (10) and the offset section (23) of the shaped plate (14) drops within the U-shaped bar (12) and shaped slot (11). The offset section (23) of the shaped plate (14) is then attached to the back of the door frame (10) by inserting and securing fasteners (20) through the holes (18) in the offset section (23) of the shaped plate (14) which align with slotted holes (22) in the U-shaped bar (12). The shaped plate (14) has a lock/latch opening (15) that surrounds the lock/latch bore (16) that is cut into the door frame (10) to allow for the throw bolt and/or latch (not shown) to pass through the door frame (10). The edge of the lock/latch opening (15) includes a support flange (19) which extends into the lock/latch bore (16). The support flange (19) is of a width, thickness and location such that it fits within the lock/latch bore (16) but still allows sufficient clearance for the latch or throw bolt (not shown) to be extended into and through the lock/latch bore (16). The length of the support flange (19) is such that it does not extend fully through the lock/latch bore (16). The shaped plate (14) also features slotted holes (17) which are positioned so that, during installation, long fasteners (not shown) can be driven though the face of the door frame (10) next to the weatherstrip slot (21), pass through the shaped plate (14) and penetrate and be secured to the wall that surrounds the entry. The locations of the slotted holes (17) are such that the heads of the fasteners (not shown) are located next to the weatherstrip slot (21) so that when the weatherstrip (not shown) is installed the heads of the fasteners (not shown) will be hidden from view.

Figure 3B:
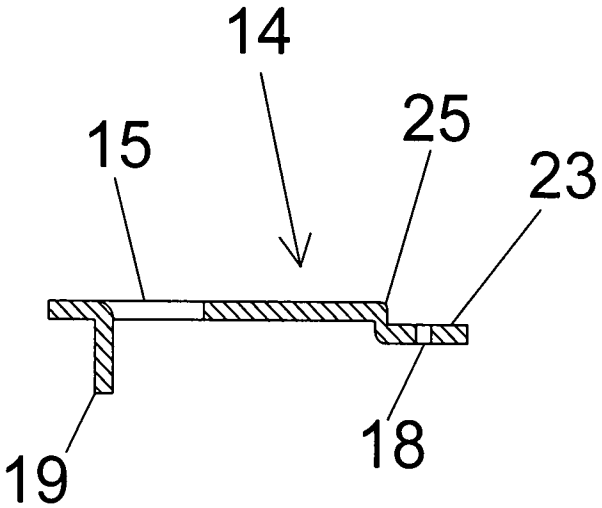
FIGS. 3A and 3B are, respectively, the face and cross-section AA' views of the shaped plate component of the described assembly.
Figure 3A:
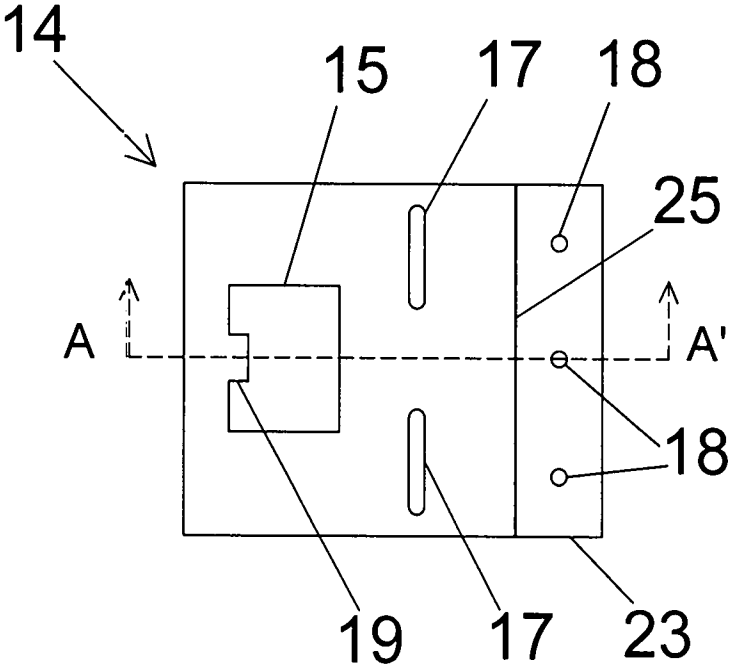

With reference to FIGS. 3A and 3B, the shaped plate (14) is shown with the lock/latch opening (15) and support flange (19) that are to, respectively, surround and fit within the lock/latch bore (not shown) of the door frame (not shown). The shaped plate (14) features a plate offset (25) that creates an offset section (23) that will fit within the U-shaped bar (not shown). The offset section (23) has a series of attachment holes (18) where fasteners (not shown) will be inserted to secure the offset section (23) of the shaped plate (14) within the U-shaped bar (not shown) and to the back of the door frame (not shown). The shaped plate (14) also features a pair of slotted holes (17) that allow for long fasteners (not shown) to pass through the shaped plate (14) as they are driven into the face of the door frame (not shown) and into the framing that surrounds the door entry. Shaped plate's (14) flange (19) and offset section (23) can be formed in metal by simple cutting and bending operations or can be produced by molding and/or machining of composite materials.

Figure 4B:
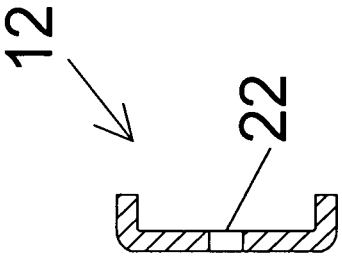
FIGS. 4A and 4B are, respectively, the face and cross-section AA' views of the U-shaped bar component of the described assembly.
Figure 4A:
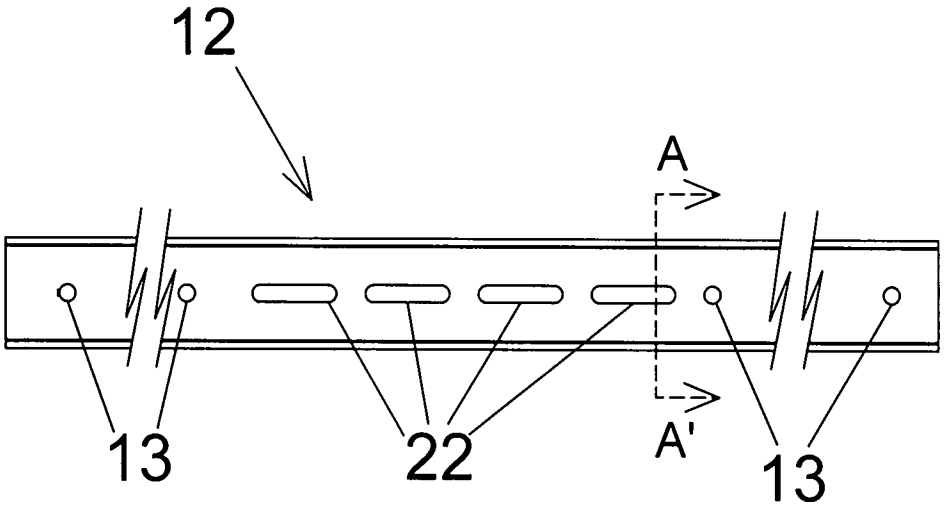

With reference to FIGS. 4A and 4B, the U-shaped bar (12) is shown with a number of attachment holes (13) and slotted holes (22) located down the centerline so that the U-shaped bar (12) can be inserted into the shaped slot (not shown) with either end oriented to the top of the door frame (not shown). When the U-shaped bar (12) has been inserted into the correct location in the shaped slot (not shown) in the back of the door frame (not shown), a series of fasteners (not shown) will be inserted through the attachment holes (13) so as to secure the shaped bar (12) firmly to the back of the door. frame (not shown). The shaped plate (14) (not shown) is then positioned within the U-shaped bar (12) and fasteners (not shown) are inserted through the attachment holes in the offset section of the shaped plate (not shown here; see FIGS. 3A/3B.) and through the slotted holes (22) and secured to the door frame (not shown) so as to hold the shaped plate (14) (not shown) securely within the U-shaped bar (12).

Figure 5:
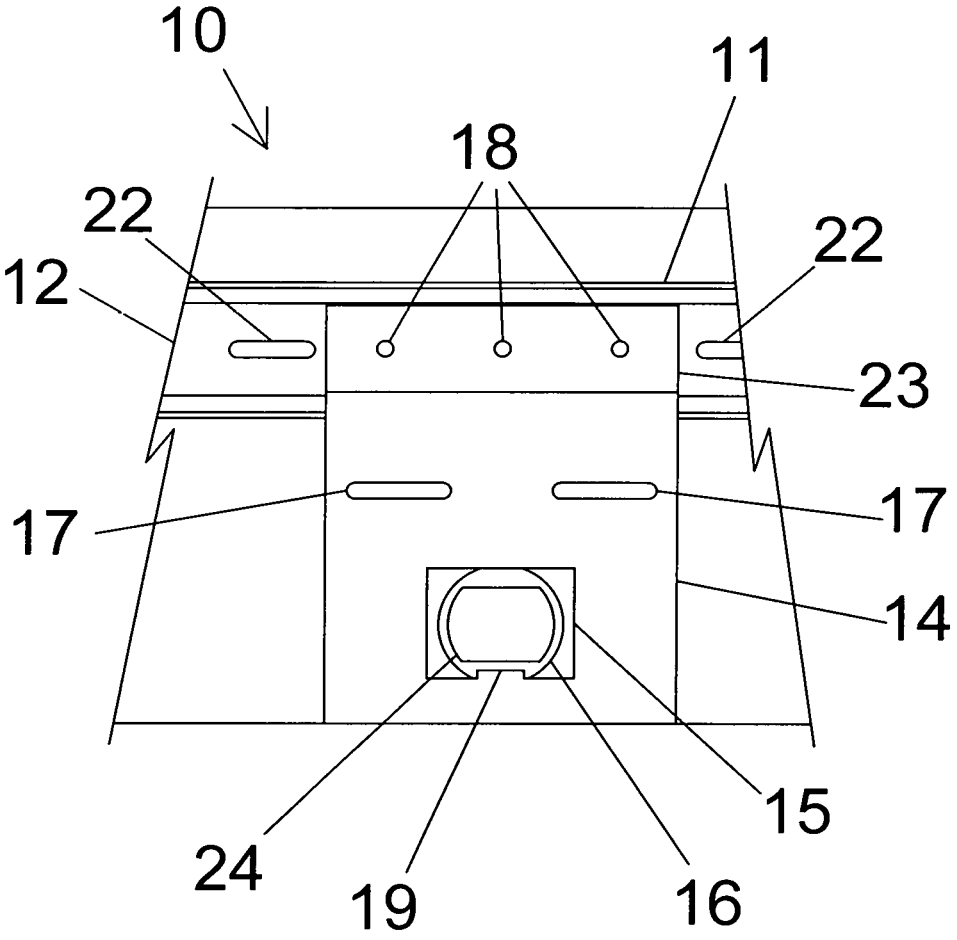
FIG. 5 is a plan view of the back of the door frame showing the location of the assembly in relation to the lock bore and throw bolt.

With reference to FIG. 5, the previously described back of the door frame (10) is shown fitted with both the U-shaped bar (12) and shaped plate (14) and with the location of the throw bolt (24) relative to these pieces shown. The U-shaped bar (12) is secured in place using fasteners (not shown) which pass through the series of attachment holes (not shown) and into the back of the door frame (10). The shaped plate (14) is secured in place using fasteners (not shown) that pass through both the attachment holes (18) and the slotted holes (22) located in the offset section (23) of the shaped plate (14) and into the back of the door frame (10). The lock/latch opening (15) surrounds the lock/latch bore (16) and the support flange (19) fits into the lock/latch bore (16). The shape, size and location of the support flange (19) is such that the throw bolt (24) of the door deadbolt has clearance and will extend through the door frame (10) without interference. The previously described slotted holes (17) in the shaped plate (14) are also shown.

Figure 6:
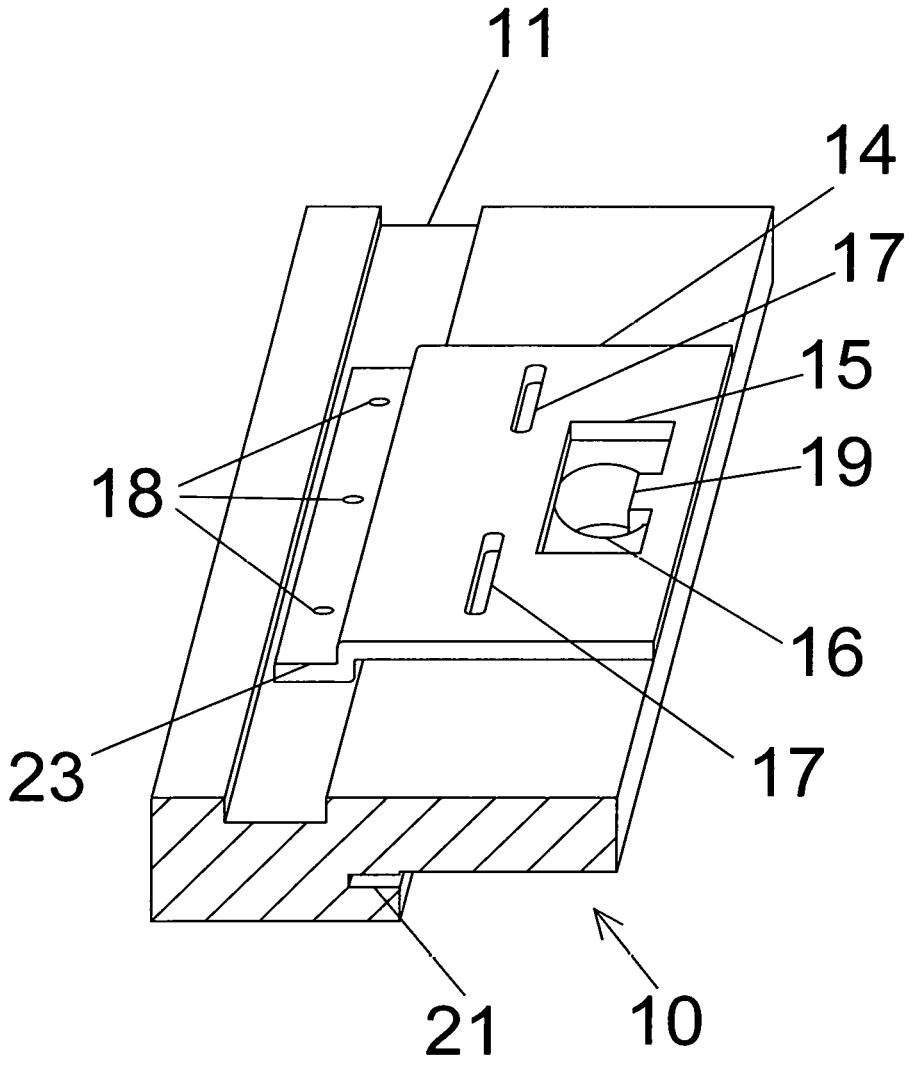
FIG. 6 is an oblique sectional view of the back of a door frame fitted with only the shaped plate.

With reference to FIG. 6, the previously described door frame (10) is shown fitted with only the shaped plate (14) within shaped slot (11), without the need of a U-shaped bar. The shaped plate (14) is secured within the shaped slot (11) using fasteners (not shown) that pass through the attachment holes (18) located in the offset section (23) of the shaped plate (14) and into the back of the door frame (10). The lock/latch opening (15) surrounds the lock/latch bore (16) and the support flange (19) fits into the lock/latch bore (16). The previously described slotted holes (17) in the shaped plate (14) are also shown.

Figure 7:
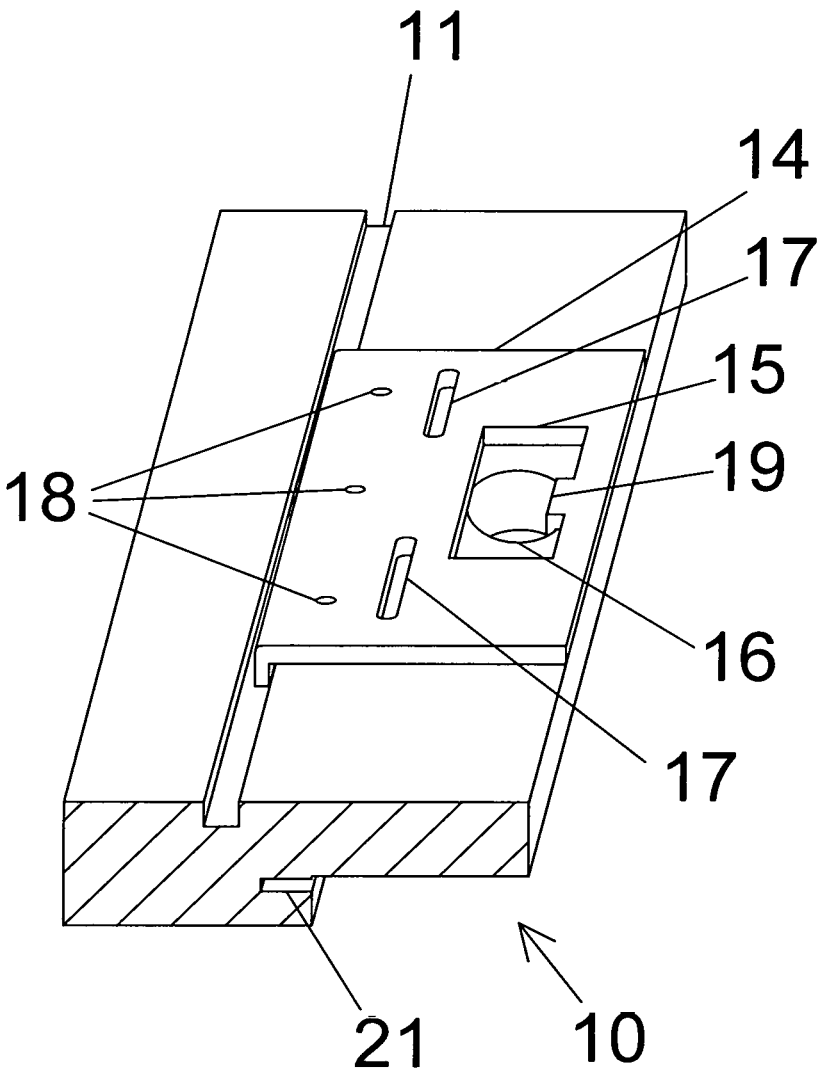
FIG. 7 is an oblique sectional view of the back of a door frame fitted with an alternative version of the shaped plate only.

With reference to FIG. 7, the previously described door frame (10) is shown fitted with only the modified shaped plate (14). The shaped plate (14) is simply secured within a shaped slot (11), of reduced width, using fasteners (not shown) that pass through the attachment holes (18), that have been moved to an alternate location in the plate (14), and into the back of the door frame (10). The lock/latch opening (15) surrounds the lock/latch bore (16) and the support flange (19) fits into the lock/latch bore (16). The previously described slotted holes (17) in the shaped plate (14) are also shown.

Figure 8:
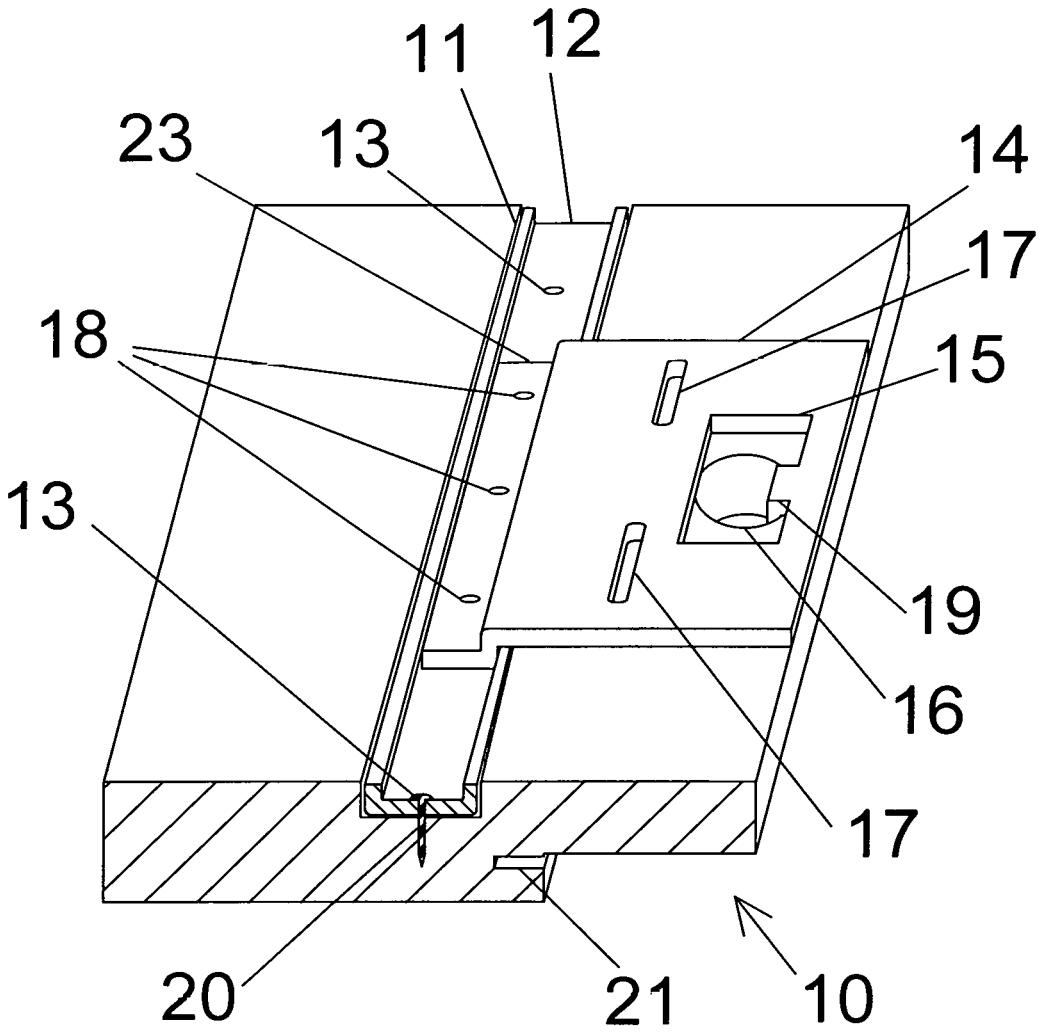
FIG. 8 is an oblique sectional view of the back of a wider door frame fitted with the described assembly.

With reference to FIG. 8, a wider version of the previously described door frame (10) is shown fitted with shaped slot (11) machined or extruded into it. The shaped slot (11) is located the same distance from the thin edge of the door frame (10), so as a result the same size U-shaped bar (12) and shaped plate (14) can be used to reinforce this wider frame without modification. Positioned where the lock/latch bore (16) is located on the door frame (10) and within the shaped slot (11) is a U-shaped bar (12). The U-shaped bar (12) is fitted with a series of attachment holes (13) that allow fasteners (20) to pass through the U-shaped bar (12) and secure it in position within the shaped slot (11) and the door frame (10). The width and depth of the shaped slot (11) are slightly greater than the width and depth of the U-shaped bar (12) so as to allow the U-shaped bar (12) to be fully contained within it. Shaped plate (14) is then aligned with the lock/latch bore (16) and set into place so that it lies flat on the back of the door frame (10) and the offset section (23) of the shaped plate (14) sets within the U-shaped bar (12) and shaped slot (11). The shaped plate (14) is then attached to the back of the door frame (10) by inserting and securing fasteners (not shown) through the attachment holes (18) in the offset section (23) of the shaped plate (14) which align with slotted holes (hidden in this view) in the U-shaped bar (12). Shaped plate (14) has a lock/latch opening (15) that surrounds the lock/latch bore (16) that is cut into the frame (10) to allow for the throw bolt of the deadbolt or latch of the lockset (not shown) to pass through the frame (10). The edge of the lock/latch opening (15) has a support flange (19) which extends into the lock/latch bore (16). The length of the support flange (19) is such that it does not extend fully through the lock/latch bore (16) so as not to interfere with the mounting of the decorative lock or latch cover (not shown). The support flange (19) is of a width and location so that it fits within the lock/latch bore (16) but still allows sufficient clearance for the latch or throw bolt (not shown) to be extended into and through the lock/latch bore (16). The shaped plate (14) also features two slotted holes (17) which are positioned so that, during installation, long fasteners (not shown) can be driven or screwed through the face of the door frame (10) adjacent to the weatherstrip slot (21), pass through the shaped plate (14) and penetrate and be secured to the framing within the wall that surrounds the entry. The location of the slotted holes (17) is such that the heads of the fasteners will be hidden from view when the weatherstrip (not shown) is installed into the weatherstrip slot (21) machined into the face of the door frame (10).

Figure 9:
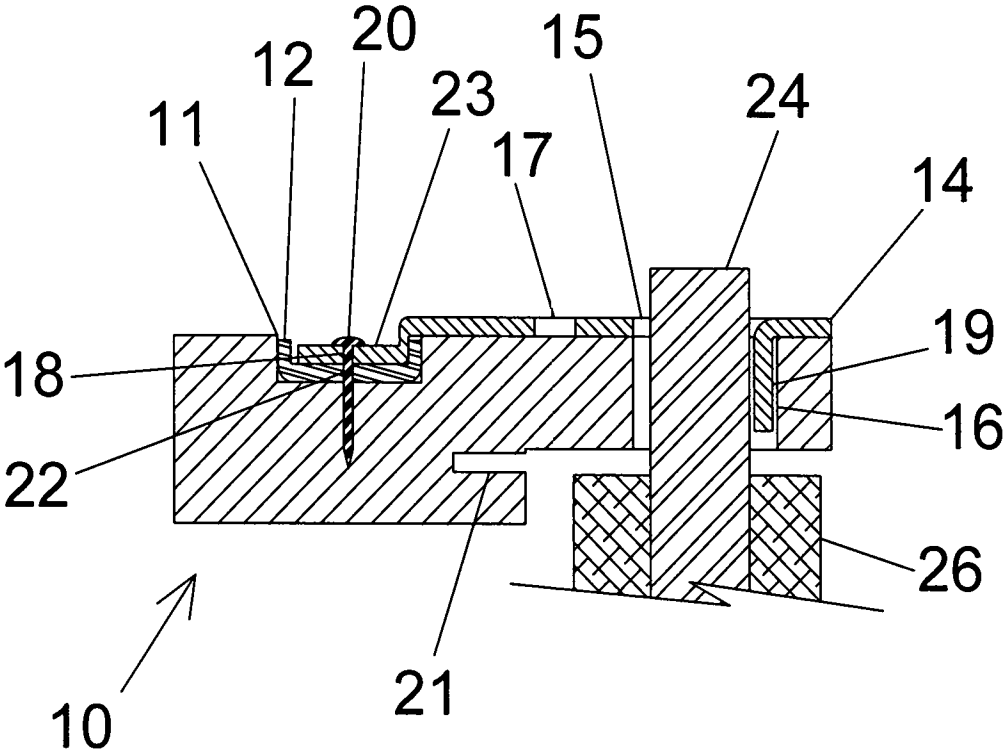
FIG. 9 is a cross section AA' view of the door frame depicted in FIG. 1 with the addition of a door edge and throw bolt extended in the locked position.

With reference to FIG. 9, the door frame (10) cross section is shown with the shaped slot (11) machined or extruded into it. Positioned where the lock/latch bore (16) is located on the door frame (10) and within the shaped slot (11) is the U-shaped bar (12). The width and depth of the shaped slot (11) are slightly greater than the outer width and depth of the U-shaped bar (12) so as to allow the U-shaped bar (12) to be fully contained within it. The shaped plate (14) is then aligned with the lock/latch bore (16) and set into place so that it lies flat on the back of the door frame (10) and the offset section (23) of the shaped plate (14) drops within the U-shaped bar (12) and shaped slot (11). The offset section (23) of the shaped plate (14) is then attached to the back of the door frame (10) by inserting and securing fasteners (20) through the holes (18) in the offset section (23) of the shaped plate (14) which align with slotted holes (22) in the U-shaped bar (12). The shaped plate (14) has a lock/latch opening (15) that surrounds the lock/latch bore (16) that is cut into the door frame (10) to allow for the throw bolt (24) of the deadbolt (not shown) to be extended from the edge of the door (26) and pass through the door frame (10) when the deadbolt (not shown) is locked. The edge of the lock/latch opening (15) includes a support flange (19) which extends into the lock/latch bore (16). The support flange (19) is of a width, thickness and location such that it fits within the lock/latch bore (16) but still allows sufficient clearance for the latch or throw bolt (24) to be extended into and through the lock/latch bore (16). The length of the support flange (19) is such that it does not extend fully through the lock/latch bore (16). The shaped plate (14) also features slotted holes (17) which are positioned so that, during installation, long fasteners (not shown) can be driven though the face of the door frame (10) next to the weatherstrip slot (21), pass through the shaped plate (14) and penetrate and be secured to the wall that surrounds the entry. The location of the slotted holes (17) is such that the heads of the fasteners (not shown) are located next to the weatherstrip slot (21) so that when the weatherstrip (not shown) is installed the heads of the fasteners (not shown) will be hidden from view.

The operation of certain disclosed embodiments will be further illustrated by the following examples:

EXAMPLES

Example 1—A U-shaped bar and shaped plate were fabricated by cutting and bending 16-gage galvanized sheet steel (ASTM A653 CS Type B) into the shapes depicted in FIGS. 3 and 4. The dimensions of the U-shaped bar were 0.875"×0.300"×15.75". The dimensions of the shaped plate were 3.600"×3.500"×0.300" (at the offset). A strike side door frame was prepared from pine lumber with a correctly sized shaped slot machined into the back of the door frame and latch/deadbolt holes and mortises were machined into the door frame. The U-shaped bar and one shaped plate were installed, as described previously in the detailed description, onto the back of the strike frame leg with the shaped plate located at the deadbolt. A hinge side door frame was prepared from pine lumber and three hinge mortises were machined into it. A door frame header was prepared from pine lumber and cut to the required length. A commercially available residential door sill was procured and trimmed to the correct length. A solid wood door (36"×78"×1¾") was prepared by machining bores and mortises for the lock and deadbolt and for three hinges. The door frame legs, door frame head and sill were assembled using 3" construction screws into a door frame and the door was mounted to the frame using three commercially available hinges. A commercially available ANSI 1 level lockset was installed in the door. Decorative latch and deadbolt cover plates (light duty) were mounted into the mortises of the strike jamb. The door and frame set were then mounted into the test fixture prescribed in ASTM F476-14. The door was closed and both the latch and deadbolt were locked. The door was then subjected to the door impact test protocol described in section 17 of ASTM F476-14 by an independent test lab. The door assembly successfully endured all levels of impact up to and including the highest Grade 40 level (two impacts each of 80, 120 160 and 200 Joules or 59.0, 88.5, 118.0 and 147.5 ft-lbf). The strike jamb showed no cracking or other damage as a result of the testing.

Example 2—A U-shaped bar and shaped plate were fabricated by cutting and bending 16-gage galvanized sheet steel (ASTM A653 CS Type B) into the shapes depicted in FIGS. 3 and 4. The dimensions of the U-shaped bar were 0.875"×0.300"×15.75". The dimensions of the shaped plate were 3.600"×3.500"×0.300" (at the offset). A strike side door frame was prepared from pine lumber with a correctly sized shaped slot machined into the back of the door frame and latch/deadbolt holes and mortises were machined into it. The U-shaped bar and one shaped plate were installed, as described previously in the detailed description, onto the back of the strike frame leg with the shaped plate located at the deadbolt. A hinge side door frame was prepared from pine lumber and three hinge mortises were machined into it. A door frame header was prepared from pine lumber and cut to the required length. A commercially available residential door sill was procured and trimmed to the correct length. A solid wood door (36"×78"×1¾") was prepared by machining bores and mortises for the lock and deadbolt and for three hinges. The door frame legs, door frame head and sill were assembled using 3" construction screws into a door frame and the door was mounted to the frame using three commercially available hinges. A commercially available ANSI 3 level lockset was installed in the door. Decorative latch and deadbolt cover plates (light duty) were mounted into the mortises of the strike jamb. The door and frame set were then mounted into the test fixture prescribed in ASTM F476-14. The door was closed and both the latch and deadbolt were locked. The door was then subjected to the door impact test protocol described in section 17 of ASTM F476-14 by an independent test lab. The door assembly successfully endured the first two levels of impact (Grade 10 and 20) and had a failure of the ANSI 3 deadbolt at the start of the Grade 30 level of testing (two impacts each of 80 and 120 Joules, failing at first impact of 160 Joules).

Published testing by Kikgard, another commercially available door reinforcement product, showed that a typical softwood door frame without reinforcement will break and allow the door to be forced open at the lowest impact level (80 Joules) so that it will fail to achieve even the lowest Grade 10 performance level. With the addition of the U-shaped bar and the shaped plate describe above, the ability of the pine door frame to resist the impact of forced entry was significantly improved so that the maximum amount of impact that the door can be subjected to without failure was determined by the strength of the lockset used, as the reinforced frame did not fail in testing.

In the foregoing description, certain terms have been used for brevity, clarity and understanding. All equivalent relationships to those illustrated in the drawings and described in the preferred embodiment are to be encompassed by this present invention to produce the intended results. It is also to be understood that the following claims are intended to cover all of the generic and specific features of the invention herein described, and all statements of the scope of the invention which, as a matter of language, might be said to fall therebetween.

Having thus described and disclosed preferred embodiment of my invention, what I claim as my invention is:

1. An entry door frame reinforcement assembly, comprising:

a) at least one shaped, generally flat plate adapted to be fastened to the back of an entry door frame adjacent the door latch and/or deadbolt receptacles in said frame, said plate comprising at least one elongated hole extending parallel to the sides of the plate and door frame and adapted to permit positioning and installation in contact with said frame using mechanical fasteners, b) a hole extending through said plate designed and adapted to accommodate said door latch and/or deadbolt when locked, with a support flange extending perpendicular to said plate adapted to fit into a portion of the opening for said door latch and/or deadbolt, and a portion of said plate extending substantially the full length of said plate and bent perpendicular to said plate, forming a flange to permit secure attachment to a groove or slit in said door frame, and further comprising:

c) a U-shaped bar having a broad "U" shaped cross section and sufficient holes along the centerline of the length thereof to permit secure installation and fastening in a rectangular groove in the back of said door frame and parallel to the length of said frame, adapted to receive said U-shaped bar, wherein (d) said shaped plate, in place of the perpendicular bend of a portion along its edge, comprises a double 90 degree bend forming a flat offset portion which extends below the plate itself and parallel thereto, being adapted to fit into said U-shaped bar, and fits the bottom surface thereof when said shaped plate is installed adjacent said U-shaped bar to reinforce said door frame adjacent said openings for said latch and/or deadbolt, wherein said shaped plate and said U-shaped bar are held in place by mechanical fasteners.

2. The assembly of claim 1, wherein said shaped plate further comprises an additional 90 degree bend on the edge opposite the latch hole which provides a flat, rectangular offset portion extending below said plate and parallel thereto which is designed and adapted to be inserted into a rectangular groove in the back of the door frame and mechanically fastened to said door frame within said groove.

3. The assembly of claim 1 wherein said groove or slit is formed in the back of said door frame during manufacture.

4. The assembly of claim 1 herein said groove or slit is cut into the back of said door frame during installation.

5. The assembly of claim 1 wherein said at least one shaped plate has sufficient length to spread impact loads along enough of the length of said door frame to prevent failure of said frame when impacts are applied to an associated door which is closed and latched to said frame.

6. The assembly of claim 1, further comprising sufficient mechanical fasteners to attach said shaped plate and said U-shaped bar to said door frame.

7. The assembly of claim 1 wherein the lengths of said shaped plate and said U-shaped bar are sufficient to spread the impact loads along enough of the length of said door frame to prevent said frame from failure when impacts are applied to an associated door which is closed and latched to said frame.

8. A reinforced door frame comprising two frame legs, a header and a sill, wherein the leg adjacent the lockset of a door to be installed therein comprises reinforcements for a strike plate of said lockset and a deadbolt throw bolt, said reinforcements comprising a) at least one shaped, generally flat plate adapted to be fastened to the back of said frame leg adjacent said lockset and/or deadbolt receptacles, said plate comprising at least one elongated hole extending parallel to the sides of the plate and door frame and adapted to permit positioning and installation using mechanical fasteners, a hole extending through said plate designed and adapted to accommodate said door latch and/or deadbolt when locked, with a support flange extending perpendicular to said plate adapted to fit into a portion of the opening for said door latch and/or deadbolt, and a portion of said plate extending substantially the full length of said plate and bent perpendicular to said plate to permit secure attachment to a groove or slit in said door frame;

b) a U-shaped bar having a broad "U" shaped cross section and sufficient holes along the centerline of the length thereof to permit secure installation and fastening to a rectangular groove in the back of said frame, adapted to receive said U-shaped bar, wherein c) said shaped plate, in place of the perpendicular bend of a portion of a portion along its edge, comprises a double 90 degree bend forming a flat offset portion which extends below the plate itself and parallel thereto, being adapted to fit into said U-shaped bar, and fits the bottom surface thereof when said shaped pate is installed adjacent said U-shaped bar to reinforce said door frame adjacent said openings for said latch and/or deadbolt, wherein said shaped plate and said U-shaped bar are held in place by mechanical fasteners.

9. A pre-hung door assembly comprising the reinforced door frame of claim 8 and a door mounted on hinges thereto.

10. A method of installing at least one entry door frame reinforcing assembly in a door frame leg, comprising steps of:

a) providing a door frame leg having a groove or slit in the back thereof, or cutting such a groove or slit into a frame leg during field installation;

b) positioning a shaped, generally flat plate comprising at least one elongated hole extending parallel to the sides of the plate, which is adapted to permit the positioning and installation of said plate in contact with said frame leg using mechanical fasteners, and further has a hole extending through said plate, so that said plate contacts the back of said frame leg in a position where said hole can accommodate a door latch or deadbolt, and further c) ensuring that a support flange extending perpendicular to said plate is fitted into a portion of the opening for said door latch or deadbolt and a portion of said plate extending substantially the full length of said plate which is bent perpendicular to said plate to form a flange is inserted securely into said groove or slit, and thereafter d) securing said shaped plate in position using mechanical fasteners, and wherein (e) said portion of said plate bent perpendicular to said plate and extending substantially its full length has an additional 90 degree bend at its end, forming a flat offset portion having a bottom surface parallel to the door frame surface and adapted to fit into a groove in said frame leg which is provided or cut wide enough to accommodate the bent portion of said plate parallel to said plate surface.

11. The method of claim 10, further comprising steps of:

a) installing a U-shaped bar having holes along the centerline thereof by positioning it in said groove and securing it therein with mechanical fasteners;

b) inserting said flat offset portion of said shaped plate into said U-shaped plate;

c) simultaneously placing said support flange into the opening for said door latch or said deadbolt; and d) securing said shaped plate in position using mechanical fasteners, wherein said offset portion of said shaped plate is adapted to fit inside said U-shaped bar.

* * * * *